US006012901A

United States Patent [19]

Bättig et al.

[11] Patent Number: 6,012,901

[45] Date of Patent: Jan. 11, 2000

[54] COMPRESSOR IMPELLER FASTENING FOR HIGH SPEED TURBOENGINES

[75] Inventors: Josef Bättig, Egliswil; Alfred Müller, Lenzburg, both of Switzerland

[73] Assignee: Asea Brown Boveri AG, Baden, Switzerland

[21] Appl. No.: 09/152,519

[22] Filed: Sep. 14, 1998

[30] Foreign Application Priority Data

Sep. 19, 1997 [EP] European Pat. Off. ..... 97810685

[51] Int. Cl.[7] ..... B63H 1/28; F01D 5/00; F03B 1/02

[52] U.S. Cl. ..... 416/244 A

[58] Field of Search ..... 416/244 R, 244 A, 416/244 B

[56] References Cited

U.S. PATENT DOCUMENTS

| | | | |
|---|---|---|---|
| 985,491 | 2/1911 | Andrade | 416/244 R X |
| 2,010,525 | 8/1935 | McHugh | 416/244 A X |
| 2,438,866 | 3/1948 | Rockwell et al. | 416/244 R X |
| 2,602,683 | 7/1952 | Aue | 416/244 A X |
| 2,992,961 | 7/1961 | Hood, Jr. et al. | 416/244 A X |
| 3,019,039 | 1/1962 | Clavell | 416/244 A X |
| 3,413,926 | 12/1968 | Ayson | 415/131 X |
| 3,612,719 | 10/1971 | Nomura | 416/244 R X |
| 3,666,302 | 5/1972 | Kellett | 416/244 A X |
| 3,865,497 | 2/1975 | Bratt et al. | 416/244 A X |
| 3,924,978 | 12/1975 | Loyd, Jr. et al. | 418/60 |
| 3,961,867 | 6/1976 | Woollenweber . | |
| 4,340,317 | 7/1982 | Heitmann et al. | 416/244 A X |
| 4,538,969 | 9/1985 | Ammann et al. | 416/244 A X |
| 4,788,740 | 12/1988 | Sovis et al. | 415/212 R X |
| 4,915,589 | 4/1990 | Gessler et al. | 416/244 A X |
| 4,925,369 | 5/1990 | Steiner et al. | 416/244 B X |
| 5,759,074 | 6/1998 | Jones | 416/244 B X |

FOREIGN PATENT DOCUMENTS

| | | |
|---|---|---|
| 0072582A2 | 2/1983 | European Pat. Off. . |
| 0522630B1 | 1/1993 | European Pat. Off. . |
| 3532348A1 | 3/1986 | Germany . |
| 3625996A1 | 2/1988 | Germany . |
| 19540745A1 | 5/1997 | Germany . |
| WO93/02278 | 2/1993 | WIPO . |

OTHER PUBLICATIONS

"Polygon—Wlllen—Nabenverbindungen",Schaudt–Korber publication Nr. 309/2. (no date).

"Informationen uber die Anwendung von Polygon–Vergindungen", Fortuna publication (no date).

Patent Abstracts of Japan, 58072602, Apr. 3, 1983.

*Primary Examiner*—John E. Ryznic

*Attorney, Agent, or Firm*—Burns, Doane, Swecker & Mathis, L.L.P.

[57] ABSTRACT

The object of the invention is to provide a safe and reproducible compressor impeller fastening for high speed turboengines, which, moreover, possesses more accurate concentricity.

This is achieved, according to the invention, in that both the hub cone (9) and the shaft cone (11) each have a mean diameter (23, 24) and these mean diameters (23, 24) are arranged at an axial distance (25) from the mass center of gravity (14) of the compressor impeller (4), said distance corresponding at least to half the mean diameters (23, 24). On the shaft side of the hub cone (9), the through bore (8) of the hub (6) is designed at least partially as a cylindrical bore (16).

11 Claims, 3 Drawing Sheets

COMPRESSOR IMPELLER FASTENING FOR HIGH SPEED TURBOENGINES

BACKGROUND OF THE INVENTION

1. Field of the Invention

The invention relates to a compressor impeller fastening for high speed turboengines according to the preamble of claim 1.

2. Discussion of Background

Compressor impellers of turboengines are connected to their driveshaft either nonpositively or positively. In the case of rising pressure ratios and consequently in the case of increasing operating torques and high circumferential speeds, positive torque transmission, that is to say a positive shaft/hub connection of the compressor impeller, is advantageous.

EP 0,522,630 B1 discloses a positive compressor impeller fastening which is produced by means of a multispline shaft. In this solution, the life of the shaft/hub connection is restricted due to the notches made by the female splines. Moreover, additional centering elements are necessary, which increase the costs of the compressor impeller. Owing to the production-related inaccuracies of multispline shafts, such a shaft/hub connection must always be balanced as a unit, the parts having to be marked accordingly for the purpose of identical reassembly. It is therefore not possible to use the compressor impeller with another shaft which is not balanced together with it. This, however, is a decisive disadvantage in the event of servicing.

Positive compressor impeller fastenings by means of a thread are known both from U.S. Pat. No. 3,961,867 and from WO 93/022778. Production-related inaccuracies of the thread are likewise a disadvantage in these cases. Moreover, the high operating torques occurring in compressor impellers necessitate high heightening and releasing torques. Particularly where larger compressor impellers are concerned, the releasing torques required for demounting are up to double the operating torque. Such forces can be exerted only by means of special tools or by means of a step-up gear. However, this markedly increases the outlay necessary for demounting compressor impellers. Another disadvantage of fastening the compressor impeller by means of a thread is that, when the compressor impeller is being mounted, the regions of the hub thread which first come into contact with the shaft thread have to cover a relatively long distance on the shaft thread until they reach their end position. Since the threads involved have scarcely any play, there is relatively high pressure between the individual thread parts, that is to say in a region without any lubrication. So-called scoring or deformation of the threads therefore occurs, so that different results are obtained during each new mounting operation. Such a connection consequently cannot be reproduced sufficiently. Moreover, these solutions relate to compressor impellers with a blind bore, which, as regards their shaft/hub connection, cannot be compared to compressor impellers which have a through bore.

According to "Informationen über die Anwendung von Polygon-Verbindungen" [Information on the use of polygonal connections], of Fortuna-Werke Maschinenfabrik AG, Stuttgart-Bad Cannstatt, a spur pinion shaft and a compressor impeller for the blower of a cooling system are known. For the rotationally fixed connection of the compressor impeller on the shaft, the two components have a conical profile with a polygonal base area, the shaft cone being arranged on the shaft end. The shaft cone and hub cone, that is to say the actual connection point of the shaft and compressor impeller, are arranged on the compressor side of the rear wall of the compressor impeller and consequently at the mass center of gravity of the compressor impeller. When the turbocharger is in operation, this region of maximum stress concentration necessarily experiences the greatest expansion, so that the safety of the connection falls with a rising circumferential speed of the compressor impeller. High speed turboengines, such as, for example, turbochargers, reach circumferential speeds of 500 m/s and above. Circumferential speeds of this kind place substantially higher requirements on the torque transmission and on the safety of the shaft/hub connection. These requirements cannot be satisfied by the conventional state of the art.

SUMMARY OF THE INVENTION

The invention attempts to avoid all these disadvantages. Accordingly one object of the invention is to provide a novel safe and reproducible compressor impeller fastening for high speed turboengines, said fastening moreover having improved torque transmission.

This is achieved, according to the invention, in that both the hub cone arranged in the through bore of the compressor impeller and the shaft cone corresponding thereto each have a mean diameter and these mean diameters are arranged at an axial distance from the mass center of gravity of the compressor impeller, said distance corresponding at least to half the mean diameters. In this case, the through bore of the hub is designed, on the shaft side of the hub cone, at least partially as a cylindrical bore.

In this arrangement, the hub cone and shaft cone, that is to say the actual fastening elements, are located outside the mass center of gravity of the compressor impeller. Substantially lower stresses caused by centrifugal forces or thermal expansions are therefore evident in the fastening region of the compressor impeller, so that the widening of the hub cone can be markedly reduced. A compressor impeller fastening which is safe even at high rotational speeds can therefore be produced. The cylindrical bore arranged on the shaft side serves as a centering seat for the compressor impeller.

Particularly advantageously, the through bore of the hub is designed, on both sides of the hub cone, at least partially as a cylindrical bore, the second cylindrical bore, that is to say the one on the compressor side, constituting a mounting aid.

In a first embodiment, the compressor impeller has a fastening bush for the shaft journal, said bush adjoining the rear wall of said impeller on the shaft side. In this case, the hub cone is arranged in the fastening bush and the cylindrical bores are arranged on both sides, that is to say the shaft side and compressor side of the hub cone. By means of this solution which is particularly suitable for internally mounted turbochargers, the distance between the fastening elements and the mass center of gravity of the compressor impeller can be increased further. This leads to an improved compressor impeller fastening which allows even higher rotational speeds at no risk.

Advantageously, a plane face is designed on the fastening bush on the shaft side of the hub and a corresponding plane stop is designed on the shaft. This ensures both unequivocal axial positioning and highly accurate concentricity of the compressor impeller.

The shaft journal is designed at least in two parts and consists of the shaft cone and of a shaft collar matching the centering seat, that is to say the cylindrical bore on the shaft side. Alternatively to the two-part design, the shaft journal is designed at least in three parts. For this purpose, it additionally has a cylindrical shaft end which serves for precentering the compressor impeller when the latter is being positioned on the shaft journal. As a result of this precentering, no radial displacement of the shaft cone and hub cone relative to one another occurs when the compressor impeller is being mounted, so that it is possible to avoid damaging the actual fastening elements. This ultimately leads to an improved shaft/hub connection and therefore to an increased service life of the compressor impeller.

At least one receiving device for a mounting/demounting tool is arranged in each case in the through bore of the compressor impeller and in the shaft journal. The compressor impeller can thereby be mounted and demounted relatively easily from the compressor side. Particularly advantageously, the receiving device of the shaft journal is arranged in the shaft end, but, in the case of a two-part shaft journal, in the shaft cone. The receiving devices are designed as internal threads, the internal thread of the shaft end or of the shaft cone being smaller than the internal thread of the hub. The mounting/demounting tool is designed as a differential screw with two external threads of different pitch. In this case, the external thread designed with the lower pitch matches the internal thread of the hub and the external thread designed with the higher pitch matches the internal thread of the shaft end or of the shaft cone.

The differential screw or its differential threads serves both as a mounting/demounting tool and for securing the compressor impeller axially on the shaft. There is therefore no need for any additional mounting/demounting tools.

In a second embodiment of the invention, the hub cone is arranged on the compressor side of the mass center of gravity of the compressor impeller. The compressor impeller is thereby subjected to much less stress by centrifugal forces or thermal expansions than if the hub cone were arranged at the mass center of gravity. In this solution, which is particularly suitable for the external mounting of turbochargers, the widening of the hub cone can be reduced to an even greater extent and, consequently, the fastening of the compressor impeller improved even further. Moreover, a shorter overall axial length is achieved.

In this solution, a plane face is designed on the hub on the compressor side of the mass center of gravity and the shaft has a corresponding plane stop. The lowest temperatures occur in this region of the compressor impeller, as compared with other regions, so that high surface pressures due to axial thermal expansions are not to be expected. The life of the shaft/hub connection can therefore be increased.

BRIEF DESCRIPTION OF THE DRAWINGS

A more complete appreciation of the invention and many of the attendant advantages thereof will be readily obtained as the same becomes better understood by reference to the following detailed description, when considered in connection with the accompanying drawings, wherein.

Only the elements essential for understanding the invention are shown. The parts of the plant which are not illustrated are, for example, the turbine side of the exhaust gas turbocharger and the internal combustion engine connected to the latter.

DESCRIPTION OF THE PREFERRED EMBODIMENTS

Figure 1:
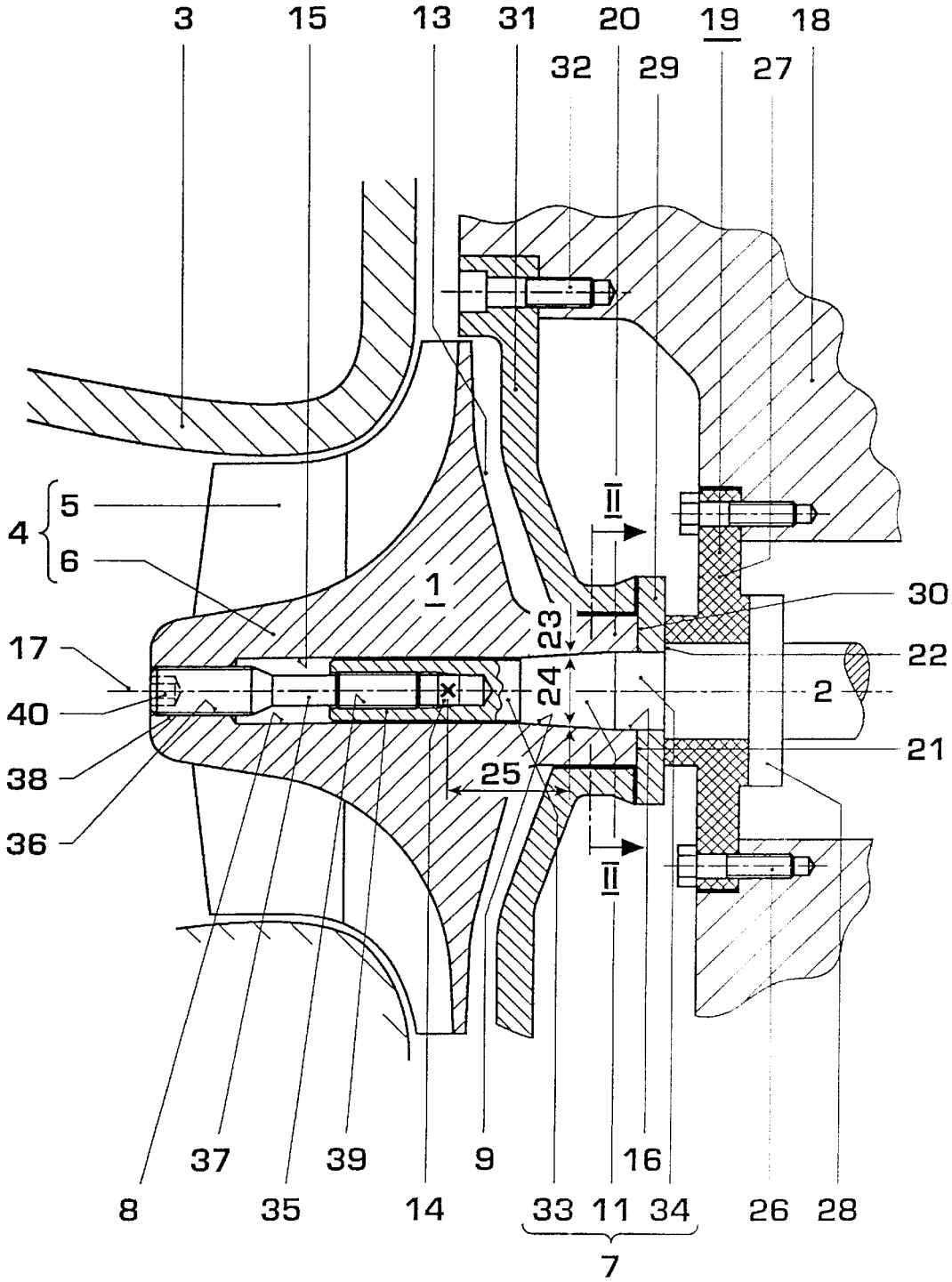
FIG. 1 shows a part longitudinal section through an internally mounted exhaust gas turbocharger, in the region of the compressor impeller.
Figure 2:
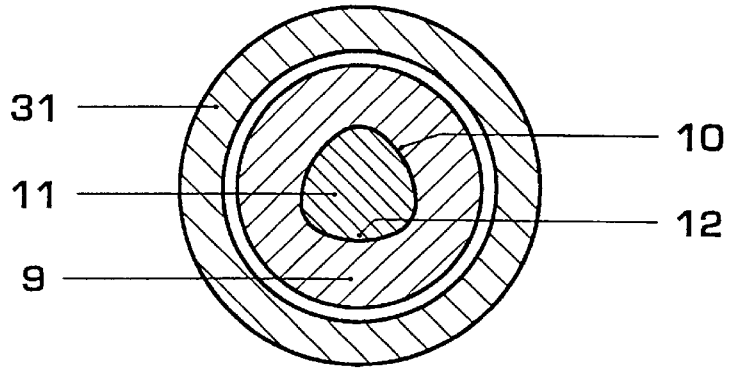
FIG. 2 shows a section II—II through the compressor impeller according to FIG. 1, in the region of the shaft cone (illustrated enlarged)

Referring now to the drawings, wherein like reference numerals designate identical or corresponding parts throughout the several views, the exhaust gas turbocharger consists mainly of a compressor 1 designed as a radial compressor and of an exhaust gas turbine, not illustrated, which are arranged on a common shaft 2. The radial compressor 1 possesses a compressor housing 3, in which a compressor impeller 4 is rotatably mounted on the shaft 2. The compressor impeller 4 has a hub 6 equipped with a multiplicity of moving blades 5. A central through bore 8 receiving a shaft journal 7 of the shaft 2 is made in the hub 6 (FIG. 1). The through bore 8 is designed partially as a hub cone 9 having a polygonal base area 10 (FIG. 2). The shaft journal 7 receives a shaft cone 11 which corresponds to the hub cone 9 and which itself likewise has a polygonal base area 12.

The hub 6 of the compressor impeller 4 is equipped on the shaft side with a rear wall 13. The compressor impeller 4 has a mass center of gravity 14 on the compressor side of the rear wall 13. The through bore 8 is designed, on both sides of the hub cone 9, as a cylindrical bore 15, 16. The two bores 15, 16 are coaxial to an axis 17 of the through bore 8.

The solution according to the invention may, of course, also be used (not illustrated) in the case of an exhaust gas turbocharger having a compressor 1 designed as an axial compressor.

In a first exemplary embodiment, the exhaust gas turbocharger possesses an internal mounting, that is to say a bearing housing 18 with an axial/radial bearing 19, in which the shaft 2 is rotatably mounted, is arranged between the turbine, or between its housing likewise not illustrated, and the compressor housing 3. A fastening bush 20 for the shaft journal 7 adjoins the rear wall 13 of the hub 6 on the shaft side. Whilst the fastening bush 20 terminates in a plane face 21, the shaft 2 has a corresponding plane stop 22. Both the hub cone 9 and the shaft cone 11 are arranged in the fastening bush 20. They each have a mean diameter 23, 24 and are arranged at an axial distance 25 from the mass center of gravity 14 of the compressor impeller 4, said distance corresponding at least to half their mean diameter 23,24. One of the cylindrical bores 15, 16 is designed in each case on each side of the hub cone 9.

The axial/radial bearing 19 consists of a bearing body 27, fixed to the bearing housing 18 by means of screws 26 and therefore stationary, and of a bearing comb 28 connected fixedly in terms of rotation to the shaft 2. The axial/radial bearing 19 is closed off relative to the compressor impeller 4 by an intermediate element 29 which is designed as an auxiliary bearing disk and which has, on the compressor side, a further stop 30 for the fastening bush 20. An intermediate wall 31 is arranged between the bearing housing 18 and the compressor housing 3 and is fixed to the bearing housing 18 by means of fastening screws 32. The intermediate wall 31 receives the fastening bush 20 of the hub 6 of the compressor impeller 4 and is sealed off relative to said bush, for example, by means of a labyrinth seal (not illustrated).

The shaft journal 7 is in three parts and consists of a cylindrical shaft end 33, of the shaft cone 11 and of a cylindrical shaft collar 34 adjoining the shaft 2. The shaft cone 11 has its smallest diameter on the side of the shaft end 33 (FIG. 1).

Both the shaft end 33 of the shaft journal 7 and the hub 6 are provided., at their end on the compressor side, in each case with a receiving device 35, 36, designed as an internal thread, for a tool 37 for mounting/demounting the compressor impeller 4, said tool being designed as a differential screw. Furthermore, the internal thread 35 of the shaft end 33 is made smaller than the internal thread 36 of the hub 6. The differential screw 37 possesses two external threads 38, 39 of different size and different pitch. The larger external thread 38 has a lower pitch and matches the internal thread 36 of the hub 6, whilst the smaller external thread 39 having the higher pitch cooperates with the internal thread 35 of the shaft end 33. Moreover, the differential screw 37 has a receptacle 40 for an actuating element, not illustrated, said receptacle being designed as a hexagon socket.

It is possible, of course, for the larger external thread 38 to have the higher pitch and the smaller external thread 39 the lower pitch, thus making it necessary, during mounting, to rotate the mounting/demounting tool 37 in the opposite direction to the solution illustrated in FIG. 1. Another mounting/demounting tool 37 for the compressor impeller 4, for example a hydraulic appliance, may, of course, also be used.

When the compressor impeller 4 is being mounted, first the differential screw 37 is screwed approximately one third into the compressor impeller 4. The compressor impeller 4 is subsequently pushed over the cylindrical shaft end 33, until the differential screw 37 comes to bear with its smaller external thread 39 on the internal thread 35 of the shaft end 33. The differential screw 37 is thereafter rotated with the aid of the actuating element, until the compressor impeller 4 rests with its plane face 21 on the stop 30. At this moment, the auxiliary bearing disk 29 serving as a bearing surface of the axial/radial bearing 19 during reverse thrust, is clamped between the plane stop 22 of the shaft 2 and the plane face 21 of the compressor impeller 4. While the compressor impeller 4 is being drawn on via the different pitch of the external threads 38, 39, the different diameters of the external threads 38, 39 rules out from the outset incorrect mounting of the differential screw 37 and consequently damage to the threads. Even when the exhaust gas turbocharger is in operation, the differential screw 37 remains in the through bore 8 and additionally secures compressor impeller 4 axially. For this purpose, after the compressor impeller 4 has been mounted, the actuating element is removed from the hexagon socket 40 of the differential screw 37. The compressor impeller 4 is demounted in reverse order.

Figure 3:
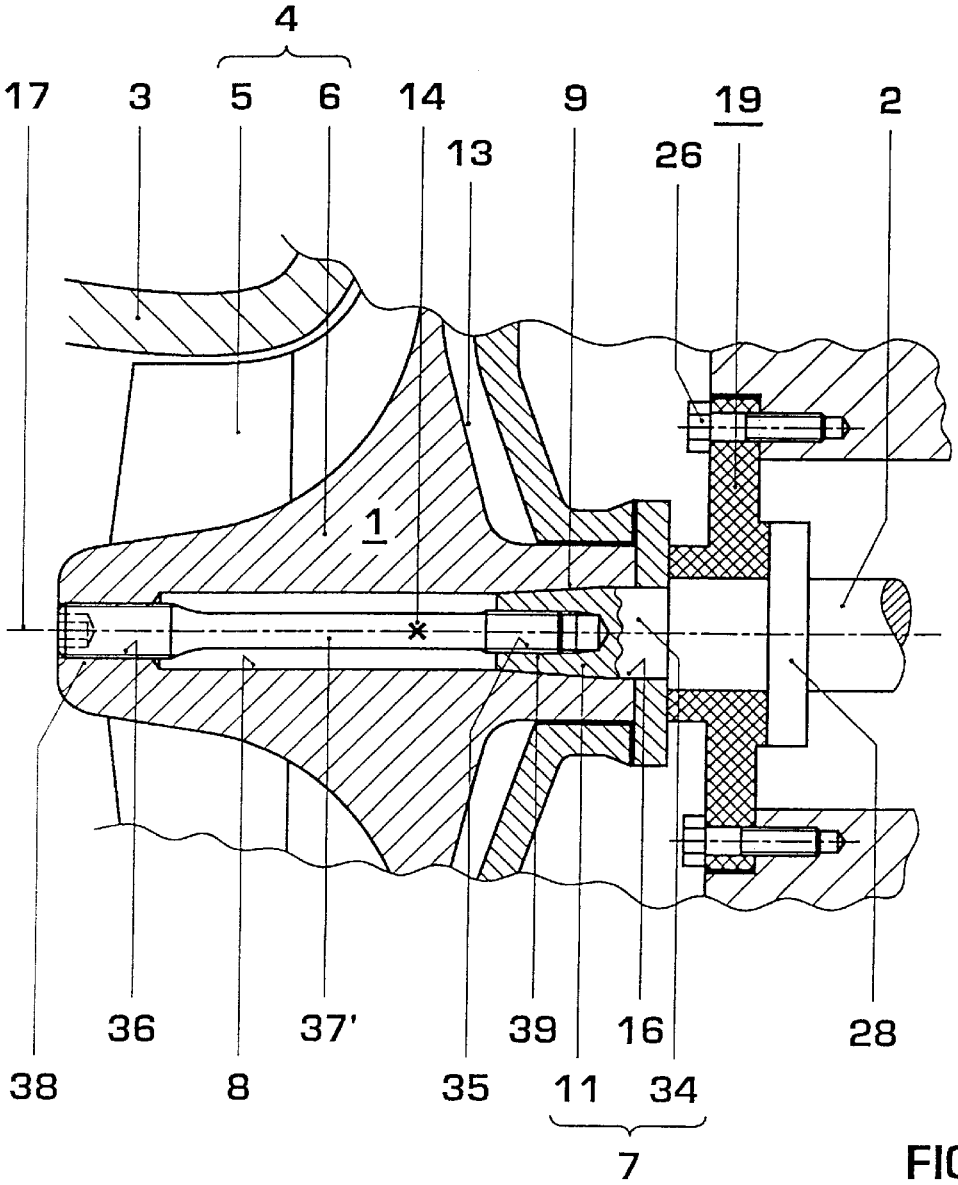
FIG. 3 shows a part longitudinal section through an internally mounted exhaust gas turbocharger, according to a second exemplary embodiment.

According to a second exemplary embodiment, the exhaust gas turbocharger likewise possesses an internal mounting. In contrast to the first exemplary embodiment, however, the shaft journal 7 is designed only in two parts and consists of the shaft cone 11 and of the shaft collar 34 corresponding to the cylindrical bore 16 on the shaft side (FIG. 3). In this case, the receiving device 35 designed as an internal thread is arranged inside the shaft cone 11, for which reason a correspondingly adapted mounting/demounting tool 37', that is to say a lengthened differential screw, is used. An alternative variant for fastening the compressor impeller 4 thus becomes available, mounting/demounting taking place in a similar way to the first exemplary embodiment.

Figure 4:
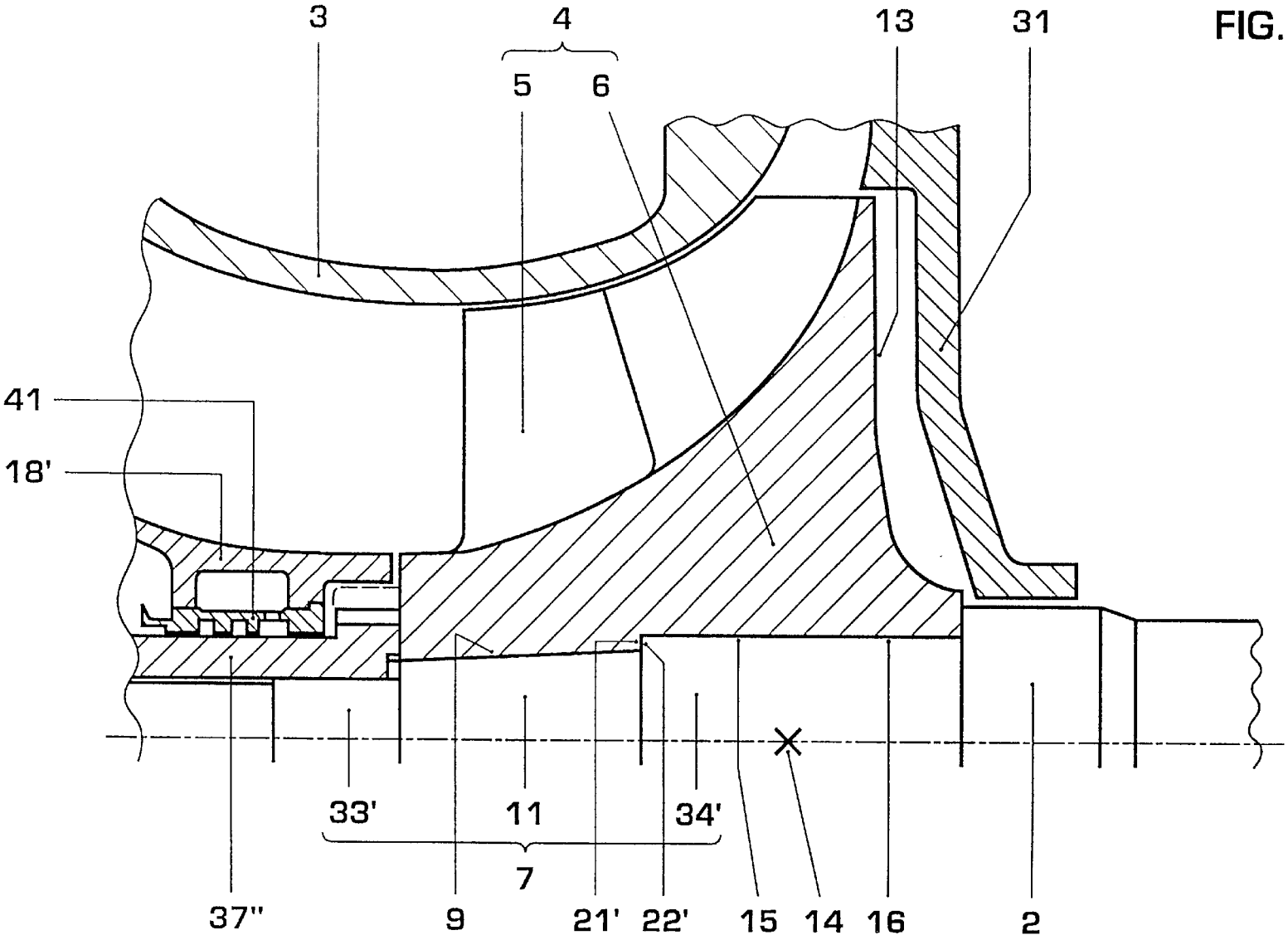
FIG. 4 shows a part longitudinal section through an externally mounted exhaust gas turbocharger, in the region of the compressor impeller.

In a third exemplary embodiment, the exhaust gas turbocharger possesses an external mounting which is arranged upstream of the compressor impeller 4 and of which only a bearing housing 18' together with a seal 41 are illustrated. Both the hub cone 9 and the shaft cone 11 are designed at the end of the compressor impeller 4 on the compressor side. The two cylindrical bores 15, 16 of the hub 6 are arranged on the shaft side of the hub cone 9. They have the same diameter and merge into one another at the mass center of gravity 14 of the compressor impeller 4. The shaft journal 7 is in three parts and consists of a cylindrical shaft end 33' for receiving a mounting/securing element 37" designed as a threaded bush, of the shaft cone 11 and of a cylindrical shaft collar 34' adjoining the shaft 2. In contrast to the first exemplary embodiment, therefore, the shaft collar 34' matches the two cylindrical bores 15, 16 of the hub 6. On the shaft side of the hub cone 9, the hub 6 has a plane face 21' which cooperates with a correspondingly designed plane stop 22' of the shaft collar 34' (FIG. 4).

For mounting, the compressor impeller 4 is first pushed onto the shaft journal 7 and is subsequently drawn onto the shaft cone 11 by means of the threaded bush 37". When the plane face 21' comes into contact with the plane stop 22', the necessary shaft/hub connection is made.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A compressor impeller fastening for high speed turboengines, with a compressor impeller which is fastened on a shaft and which comprises a hub equipped with a plurality of moving blades and designed with a rear wall and has a mass center of gravity on the compressor side of the rear wall, the hub being provided with a central through bore for receiving a shaft journal of the shaft, and the through bore being designed at least partially as a hub cone with a polygonal base area, the shaft journal having a shaft cone cooperating with the hub cone, and said shaft cone possessing a polygonal base area corresponding to the base area of the hub cone, wherein a) both the hub cone and the shaft cone each have a mean diameter, and these mean diameters are arranged at an axial distance from the mass center of gravity of the compressor impeller, said distance corresponding at least to half the mean diameters, b) the through bore of the hub is designed, on the shaft side of the hub cone, at least partially as a cylindrical bore.

2. The compressor impeller fastening as claimed in claim 1, wherein the through bore of the hub is designed, on both sides of the hub cone at least partially as a cylindrical bore.

3. The compressor impeller fastening as claimed in claim 2, wherein the hub of the compressor impeller has a fastening bush for the shaft journal, said bush adjoining the rear wall on the shaft side, the hub cone being arranged in the fastening bush and the cylindrical bores being arranged on both sides of the hub cone .

4. The compressor impeller fastening as claimed in claim 3, wherein a plane face is designed on the fastening bush on the shaft side of the hub and the shaft has a corresponding plane stop.

5. The compressor impeller fastening as claimed in claim 4, wherein the shaft journal is designed at least in two parts and consists of the shaft cone and of a shaft collar matching the cylindrical bore on the shaft side.

6. The compressor impeller fastening as claimed in claim 4, wherein the shaft journal is designed at least in three parts and consists of the shaft cone, of a shaft collar matching the cylindrical bore on the shaft side and of a cylindrical shaft end.

7. The compressor impeller fastening as claimed in claim 5, wherein at least one receiving device for a tool for mounting/demounting the compressor impeller, said tool being designed preferably as a differential screw with two external threads of different pitch, is arranged in each case in the shaft journal and in the through bore.

8. The compressor impeller fastening as claimed in claim 7, wherein the two receiving devices are designed as internal threads, and the receiving device of the shaft journal is arranged in the shaft end and is designed to be smaller than the receiving device arranged in the through bore of the hub.

9. The compressor impeller fastening as claimed in claim 7, wherein the two receiving devices are designed as internal threads, and the receiving device of the shaft journal is arranged in the shaft cone and is designed to be smaller than the receiving device arranged in the through bore of the hub.

10. The compressor impeller fastening as claimed in claim 1, wherein the hub cone is arranged upstream of the mass center of gravity of the compressor impeller.

11. The compressor impeller fastening as claimed in claim 10, wherein a plane face is designed on the hub on the compressor side of the mass center of gravity and the shaft has a corresponding plane stop.

* * * * *